US005083609A

United States Patent [19]

Coleman

[11] Patent Number: 5,083,609

[45] Date of Patent: Jan. 28, 1992

[54] DOWN HOLE JET PUMP RETRIEVABLE BY REVERSE FLOW AND WELL TREATMENT SYSTEM

[76] Inventor: William P. Coleman, 4010 Boy Scout Blvd., Tampa, Fla. 33607

[21] Appl. No.: 615,245

[22] Filed: Nov. 19, 1990

[51] Int. Cl.[5] ..... E21B 43/00

[52] U.S. Cl. ..... 166/68; 166/105

[58] Field of Search ..... 166/107-110, 166/68, 105, 369, 373, 381; 417/76, 172, 195-198

[56] References Cited

U.S. PATENT DOCUMENTS 4,603,735 8/1986 Black ..... 166/105 X
4,658,893 4/1987 Black ..... 166/68
4,790,376 12/1988 Black ..... 166/68

*Primary Examiner*—Thuy M. Bui
*Attorney, Agent, or Firm*—Fleit, Jacobson, Cohn, Price, Holman & Stern

[57] ABSTRACT

A down hole jet pump for production of fluid from a well with the jet pump being powered from a pressure source at the surface and discharging production fluid through production tubing to the surface. The down hole jet pump of this invention is retrievable by reverse flow of fluid down the production tubing to move the jet pump upwardly through the power fluid tubing to the surface. The components of the jet pump are removable and adjustable in the field without the use of special tools thereby enabling the pump to be adjusted to provide optimum operating conditions for each installation and enable interchange and replacement of parts. The down hole jet pump includes passageways for the power fluid, the inlet of production fluid into the throat of the jet pump and for the mixed production fluid and power fluid which is discharged to the production tubing with these passageways being parallel but not concentric in relation to each other thereby enabling the use of larger passageways then if the passageways were concentric thereby providing larger internal clearances which are not as prone to blockage from scale formation, salt, asphalt, sand and similar materials that may be entrained in the production fluid. The lower end of the jet pump assembly may be provided with a structure to remove the ball check valve or foot valve from its seat to enable treating fluid to be pumped down into the formation for treatment of the well.

7 Claims, 3 Drawing Sheets

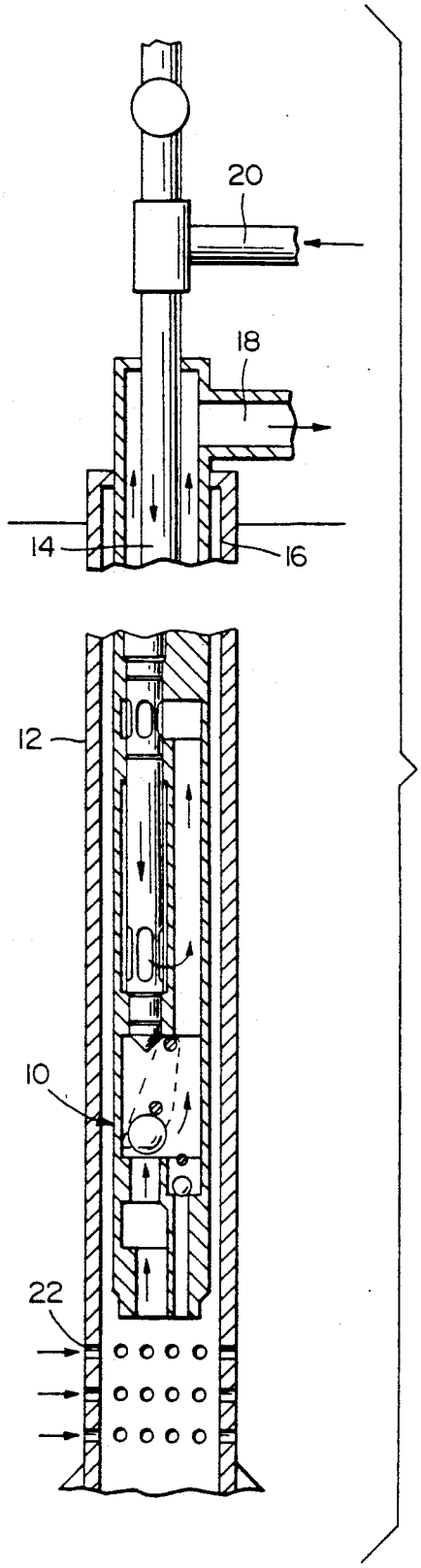
FIG. 1
FIG. 2
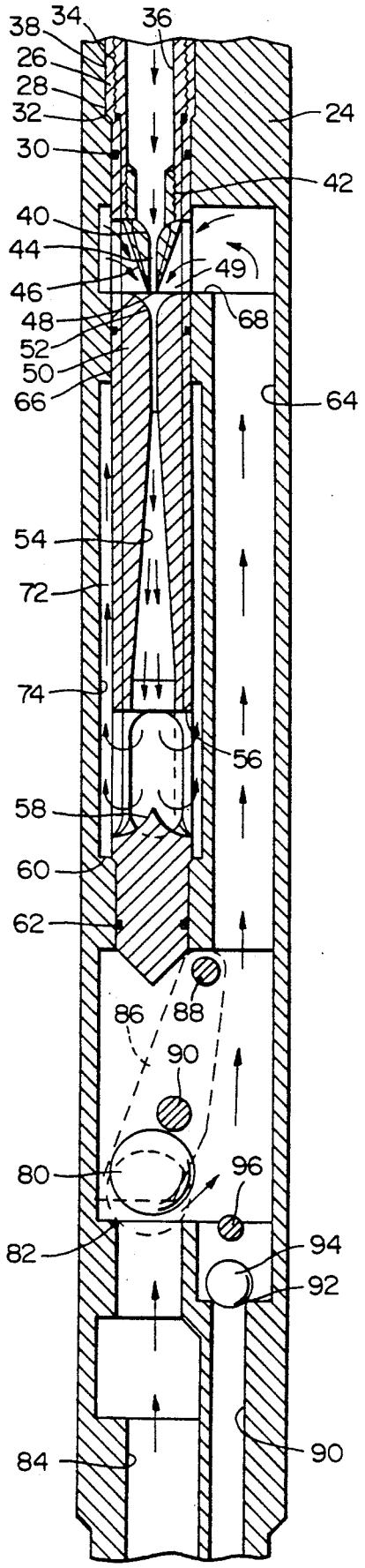

DOWN HOLE JET PUMP RETRIEVABLE BY REVERSE FLOW AND WELL TREATMENT SYSTEM

BACKGROUND OF THE INVENTION

1. Field of the Invention

The present invention generally relates to a down hole jet pump for production of fluid from a well with the jet pump being powered from a pressure source at the surface and discharging production fluid through production tubing to the surface. The down hole jet pump of this invention is retrievable by reverse flow of fluid down the production tubing to move the jet pump upwardly through the power fluid tubing to the surface. The components of the jet pump are removable and adjustable in the field without the use of special tools thereby enabling the pump to be adjusted to provide optimum operating conditions for each installation and enable interchange and replacement of parts. The down hole jet pump includes passageways for the power fluid, the inlet of production fluid into the throat of the jet pump and for the mixed production fluid and power fluid which is discharged to the production tubing with these passageways being parallel but not concentric in relation to each other thereby enabling the us of larger passageways then if the passageways were concentric thereby providing larger internal clearances which are not as prone to blockage from scale formation, salt, asphalt, sand and similar materials that may be entrained in the production fluid. The lower end of the jet pump assembly may be provided with a structure to remove the ball check valve or foot valve from its seat to enable treating fluid to be pumped down into the formation for treatment of the well.

2. Description of the Prior Art

Various procedures have been developed for delivering oil, gas or water from their normally located underground position to the surface of the earth in order for such fluids to be utilized. Production of underground fluid usually includes the drilling of a well into the formation containing the desired fluids and in some instances, sufficient bottom hole pressure is available to force the production fluids to the surface where it is collected and utilized for commercial purposes. When natural lifting of the well is not sufficient to deliver the production fluids to the surface, a pump is inserted into the well to lift the production fluids. One type of pump used is a reciprocating piston-type pump lowered into the well and operated by a sucker rod extending from the pump to the surface for connection with some type of mechanism to reciprocate the pump. This type of pump is rather costly and requires rather complex operating mechanisms and costly maintenance. There has also been developed a down hole jet pump which has a significant advantage over other pumps since it does not utilize down hole moving parts which reduces the initial cost and maintenance costs by enabling retrieval of the jet pump by reverse flow in the well thereby providing a pump which is more economically feasible from the standpoint of initial cost and maintenance costs. The down hole jet pump of the present invention operates on accepted and well known principles and the following patents disclose related pump structures.

U.S. Pat. No. 823,658
U.S. Pat. No. 1,161,724
U.S. Pat. No. 1,782,310
U.S. Pat. No. 1,992,436
U.S. Pat. No. 2,080,623
U.S. Pat. No. 2,080,624
U.S. Pat. No. 2,468,642
U.S. Pat. No. 2,869,470
U.S. Pat. No. 3,216,368
U.S. Pat. No. 3,367,269
U.S. Pat. No. 3,551,074
U.S. Pat. No. 4,135,861
U.S. Pat. No. 4,171,016
U.S. Pat. No. 4,183,722
U.S. Pat. No. 4,285,638
U.S. Pat. No. 4,293,283
U.S. Pat. No. 4,504,195
U.S. Pat. No. 4,658,893
U.S. Pat. No. 4,664,603

The above prior patents do not disclose the unique features of this invention.

SUMMARY OF THE INVENTION

An object of the present invention is to provide a down hole jet pump which is retrievable by reverse flow through a production tube and power fluid tube to move the jet pump upwardly through the power fluid tubing to the surface into a catch basket to enable the jet pump components to be interchanged, replaced and adjusted with the passageways in the jet pump being generally parallel but not concentric to provide larger passageways thereby eliminating the tendency of blockage due to formation of scale on concentric surfaces as well as blockage due to salt, asphalt and other similar materials as occurs when using concentric passageways for power fluid, production fluid from the formation entering the et pump and the mix discharge of power fluid and production fluid into the production tubing.

Another object of the invention is to provide a down hole jet pump including a nozzle which converts the pressure of the power fluid to a high velocity fluid, an intake that directs production fluid from the formation into the nozzle and a throat where the fast moving, high velocity power fluid impinges on the incoming production fluid from the formation and the mix stream moves at a velocity determined by the characteristics of the fluids and the initial velocity of the power fluid with a diffuser being utilized where the velocity of the mix stream of fluids is converted to pressure. With these components being adjustable and removable without the use of special tools thereby enabling interchange, replacement and adjustment in the field to adjust the pump capacity to an optimum relation to the installational requirements.

A further object of the invention is to provide a down hole jet pump which includes a structure enabling movement of a bottom check valve from its seat to enable passage of treating fluid into the well for the purpose of treating the well to increase production.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic illustration of the down hole jet pump of present invention illustrating a typical installation in association with a well.

FIG. 2 is a longitudinal sectional view of the down hole jet pump.

DESCRIPTION OF THE PREFERRED EMBODIMENT

Figure 3:
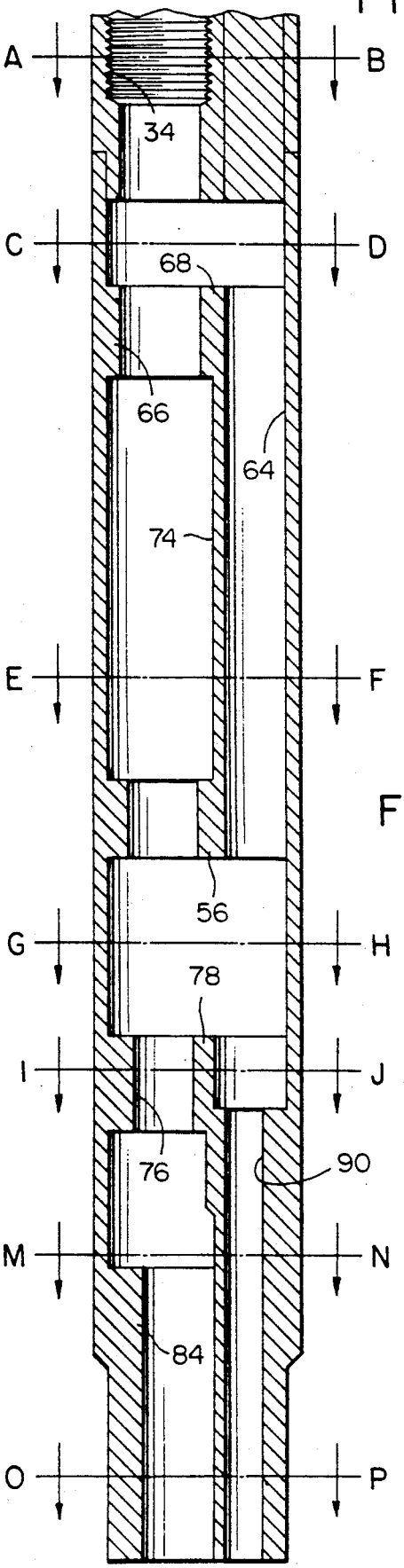
FIG. 3 is a longitudinal sectional view of the pump body with the pump components removed.

Referring now specifically to the drawings, the down hole jet pump of the present invention is generally designated by reference numeral 10 and is positioned in a well casing 12 and includes a power fluid or motive fluid tubing 14 which extends from the surface to the pump 10 and a production tubing 16 which also extends from the pump 10 to the surface with the production tubing extending to a separator and storage tanks through a tube or pipe 18. The power fluid tubing is communicated with a surface pump through a tube or pipe 20. The lower end of the casing 12 is provided with perforations 22 to allow inflow of production fluid from a formation into the lower end of the casing 12 in a manner well known in this art.

Figure 5:
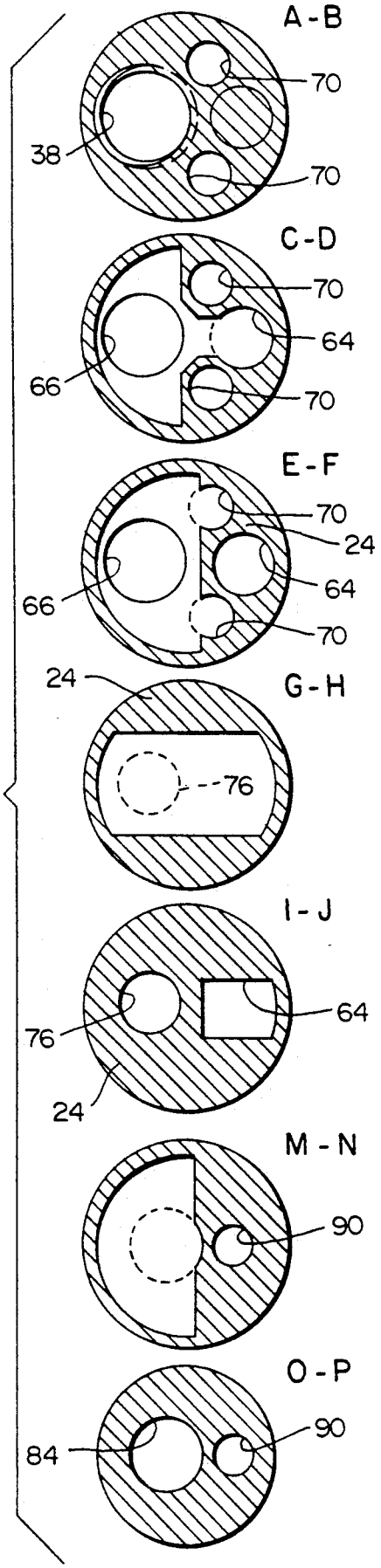
FIG. 5 is a plurality of transverse sectional views taken along section lines A-B through O-P on FIG. 3 illustrating the construction of the pump body at vertically spaced points.
Figure 4:
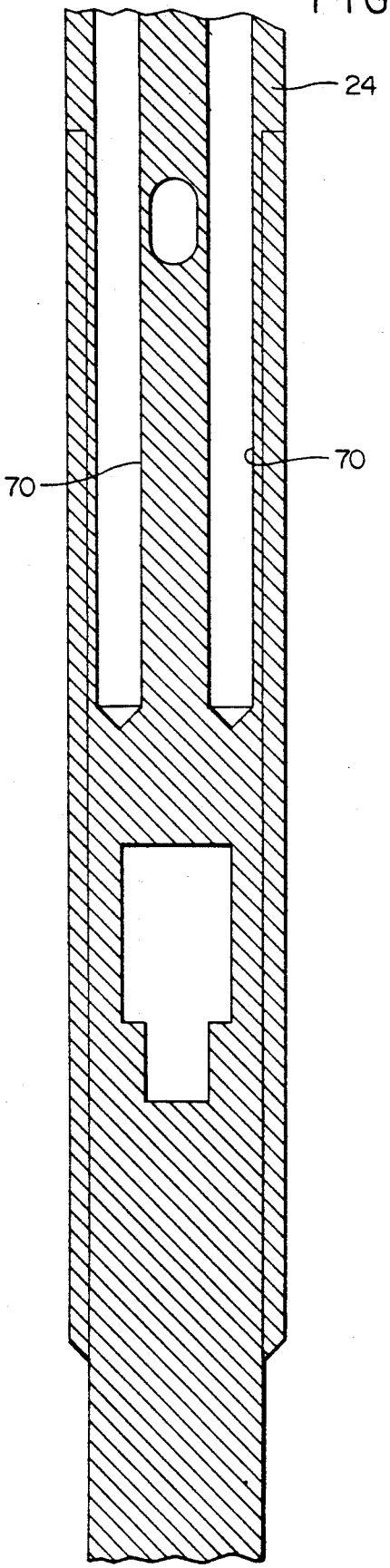
FIG. 4 is a longitudinal sectional view similar to FIG. 3 but taken on a plane perpendicular to the plane of FIG. 3.

The pump 10 includes a pump housing 24 which includes an off center bore 26 receiving a pump body 28 which is sealed thereto by an O-ring seal 30 and seated on a shoulder 32. The upper inner end of the pump body 28 is internally threaded at 34 for screw threaded engagement and adjustable mounting of a nozzle support or carrier 36 which is externally threaded at 38 for adjustment. A jet nozzle 40 is adjustably and removably supported from the carrier 36 by a screw threaded connection 42 with the nozzle including a restricted passageway 44 and a tapered outer surface 46 which terminates in a discharge tip 48. The tip 48 and a throat 50 are spaced to form a venturi 49. The throat 50 is spaced below and in alignment with the nozzle tip 48 and has a restricted passageway 52 therein which extends to and communicates with an outwardly tapering diffuser passage 54 which terminates at a plurality of lateral ports 56. Below the ports 56 is a deflector surface 58 which deflects fluid laterally outwardly from the pump body 28 which rests against a seat 60 in the housing 24. The deflector 58 forms the bottom of the pump and O-ring seal 62 is provided to seal the lower end of the pump body 28 to the housing 24. Parallel to the pump body 28, the housing 24 is provided with a longitudinal passageway 64 which is parallel to the passageway 66 which receives the pump body 28 as illustrated in FIG. 5 with the passageway 64 being aligned with but spaced from the passageway 66. The upper end of the passageway 64 includes a lateral branch 68 that communicates with the venturi 49 at the upper end of the throat 50 in a manner that the power fluid being discharged through the nozzle tip 48 at a high velocity will impinge on the production fluid at the entrance to the throat and the power fluid and mixed production fluid then proceeds through the throat and diffuser and discharges laterally through ports 56 as illustrated by the arrows in FIG. 2. The housing 24 also includes a pair of passageways forming discharge ports 70 which are parallel to the passageways 64 and 66 with the upper ends of the discharge ports 70 communicating with the annulus between the power fluid tubing 14 and the production tubing 16. The lower ends of the discharge ports 70 are in communication with the annulus 72 between the exterior of the pump body 34 and the interior of a recess 74 in the port 66 which receives the pump body 28. Thus, the power fluid mixes with and entrains the production fluid and discharges mixed power fluid and production fluid into the passageway 66 and annulus 72 which communicates with the discharge ports 70 and the annulus between the power fluid tubing and production tubing.

The lower end of the housing 24 includes a passageway 76 having a valve seat 78 at its upper end engaged by and supporting a ball check valve 80 which forms a standing valve. The passageway 76 includes a port 82 and inlet 84 communicating with the casing for admitting production fluid into the area above the ball check valve 80 and the lower end of the pump body 28 for entrainment of the production fluid with the mixed fluid in passageway 64 which ultimately is discharged through the discharge port 70 to surface. A ball check valve cage 86 is pivotally supported by pivot pin 88 at its upper end in alignment with the inner lower edge of the port 56 as illustrated in FIG. 2. The ball valve cage 86 is normally retained in position by a pin 90 and enables the check valve 80 to move away from valve seat 78 a predetermined distance with the ball valve 80 being retained in alignment with the seat 78 so that it functions as a foot valve. The lower end of the housing 24 includes a passageway 90 parallel to the passageway 76 with the passageway 90 terminating at its upper end and a ball valve seat 92 receiving a ball check valve 94 retained in place by a pin 96. The ball valve 94 is normally nonfunctional when the jet pump is operating although it can introduce production fluid if desired depending upon the capacity of the pump.

The previously described structure enables a treatment tool 100 to be inserted into the housing 24 when the pump body and other pump components have been removed. The treatment tool 100 is a long tubular member having a shoulder 102 which engages the shoulder 60 and a tapered point 104 having a plurality of discharge orifices 106 therein which communicate with a central passageway 108. When the tool 100 is lowered into the passageway 66 in the housing 24, the tapered end will engage the cage 86 and swing it to the right as observed in FIG. 6 so that the ball valve 80 will overlie the pin 96 and fluid can be introduced into the passageway 84 and into the formation with the treating fluid treating the formation and returning through the passageway 90 past the ball check valve 94 which will be lifted off the valve seat due to circulation of the fluid which passes down through the passageway 108, the passageway 84 and returns through the passageway 90 into the passageway 64 and then into the port 68 and down in the annulus 110 between the passageway 66 and the tubular treatment tool 100. The upper end of the tool 100 includes a spring biased check valve 112 and includes a seat 114 engaging the seat 32 in the housing 24 so that it, in effect, replaces the pump body and associated components of the down hole jet pump.

The jet pump body 28 and the components mounted therein including the nozzle carrier, the nozzle, the throat and diffuser are retrieved at the surface by reverse flowing power fluid down the production tubing with this reverse flow passing downwardly through the discharge port 70 and into the annulus 72 between the recess 74 and the exterior of the pump body thus "pumping" the down hole pump upwardly through the power fluid tubing 14 where it can be removed from the system by entering a catch basket. This enables the pump to be removed for repair, replacement of parts or adjustment as desired and also enables the pump to be removed for insertion of the treatment tool 100.

The housing 24 is of standardized construction and directs fluid to and from the jet pump with very little restrictions and enables jet pumps having different characteristics and having an external standard configuration to be seated in the housing with the nozzle, venturi, throat and diffuser all being totally and individually adjustable and replaceable. The size characteristics of the nozzle, venturi, throat and diffuser may vary depending upon the installational requirements. The down hole jet pump of this invention enables a low initial cost to be attained as well as a low installation cost and operating cost. The simplicity of the pump enables it to be easily and quickly retrieved, handled, cleaned and returned to its down hole operative position. The simplicity of the structure and its ease of retrieval enables inexpensive repair and replacement and the small number of components enables effective repair and replacement of parts from a relatively small inventory of spare parts.

Figure 6:
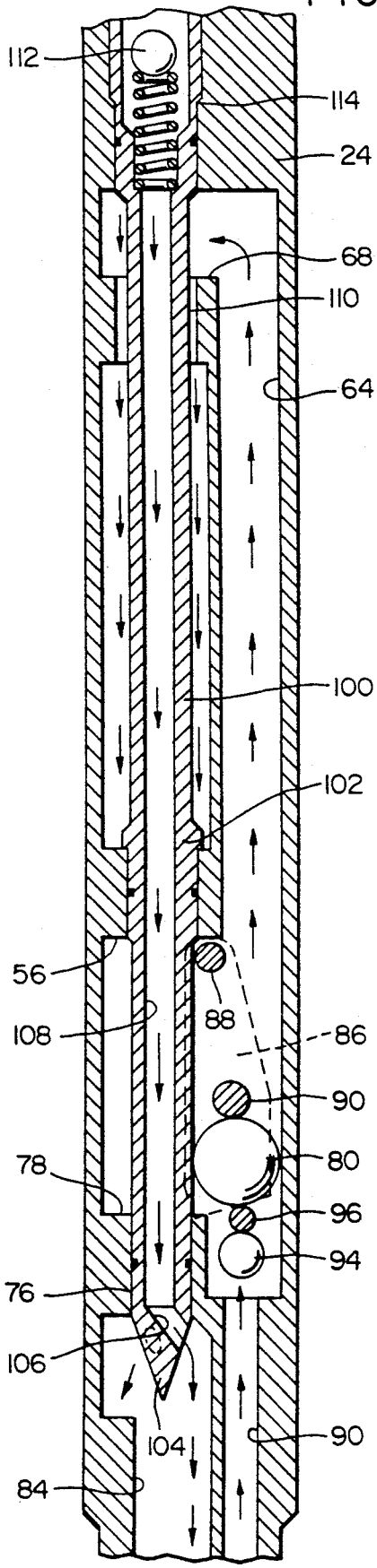
FIG. 6 is a sectional view similar to FIG. 2 but with the pump removed and a well treating structure inserted into the pump body.

The well treating feature of the invention as illustrated in FIG. 6 enables that portion of the well below the standing valve at the pump section to be treated thereby eliminating the need to use wireline or workover rigs, coil tubing or nitrogen displacement which sometimes can result in the well being down for several days thus introducing considerable expense as well as risk to the well. In this arrangement, a simple tool 100 can be pumped into the housing in place of the retrievable pump and the section of the well below the standing valve 80 becomes accessible to fluid pumped by the power fluid unit through the perforations to treat the formation and after treatment, the tool 100 can be retrieved to the surface by the same reverse flow method used to retrieve the pump. Thus, the pump can be quickly and easily removed and replaced by the treating tool 100 and after treatment, the tool can be easily retrieved by reverse power flow and the pump can then be pumped back into position. In the event the pump housing 24 needs to be replaced, it can be easily and quickly retrieved by the simple expedient of pulling the power fluid tubing 14 to which the pump housing is attached and this entire operation can be accomplished in a relatively short time.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A down hole jet pump for a well having a casing extending into a formation producing a fluid with the casing communicated with the formation through perforations in the lower end portion of the casing, a pump housing adapted to be positioned in the lower end portion of a casing, said pump housing including a standing valve at the lower end thereof, said pump housing including a vertical cavity therein and a plurality of passageways with the passageways being generally parallel to and spaced laterally from the cavity and in non-concentric relation thereto with the passageways enabling flow into and from the pump housing, a jet pump mounted vertically in the housing, said jet pump including a pump body, a vertically adjustable nozzle, a venturi, throat and diffuser, a power fluid tubing connected to said pump housing at its upper end and extending to surface for receiving power fluid to pass through the pump, said pump housing including a production tubing connected thereto and extending to surface for passage of production fluid, said pump body including port means for introducing production fluid into the venturi for mixing with the power fluid passing through the pump, said passageways including a passageway communicating with said port and the discharge end of the pump for circulation of power fluid and production fluid through the venturi and a pair of discharge ports communicating with the discharge of the pump and the production tubing for discharging a portion of the mixed production fluid and power fluid upwardly into the production tubing and to the surface for separation.

2. The pump as defined in claim 1 wherein said pump body includes a discharge port communicating with the discharge end of the diffuser of the pump with discharge port in the pump body communicating the pump with the passageway returning mixed power fluid and production fluid back to the venturi and to the discharge ports with the power fluid passing downwardly through the jet pump mixing with production fluid with some power fluid therein at the venturi and being discharged through the discharge port for entrainment of additional production fluid and causing upward movement thereof into the production tubing.

3. The pump as defined in claim 2 wherein said passageway returning the mixed power fluid and production fluid to the venturi of the pump extending vertically for a major portion of the length of the pump, said discharge ports being in the form of parallel passageways spaced laterally from the passageway returning mixed fluids to the pump, the lower ends of the discharge ports being communicated with the lateral port in the pump housing to enable passage of mixed power fluid and production fluid into the discharge ports and upwardly into the production tubing.

4. The pump as defined in claim 3 wherein said pump housing includes upwardly facing shoulder means to engage downwardly facing shoulder means on the pump body and means sealing the pump body to the pump housing when the pump is moved vertically into the housing, said pump body and other components being retrievable by reverse circulation of power fluid down through the production tubing for moving the pump upwardly to surface for repair or replacement.

5. The pump as defined in claim 4, wherein said standing valve includes a ball valve and ball valve seat, a pivotal cage retaining said ball valve associated with the ball valve seat, a well treating tool being pumped into the pump housing when the pump has been removed and including a passageway therethrough, the lower end of the well treating tool including discharge nozzle means and an external surface engageable with the cage to move the ball valve away from the ball valve seat to enable treating fluid to be pumped down through the treating tool and through the standing valve seat fir discharge through the perforations in the casing into the formation.

6. The pump as defined in claim 5 wherein said pump housing includes a bottom passageway terminating in a valve seat spaced from the standing valve seat and a secondary ball valve engaged with the valve seat spaced from the standing valve seat to enable circulation of the treating fluid back into the passageways in the pump housing for discharge through the production tubing.

7. The pump as defined in claim 6 wherein said treating tool includes downwardly facing shoulder means to engage the shoulder means on the pump housing to enable the treating tool to be retrieved by reverse flow of fluid down through the production tubing, into engagement with the bottom end of the treating tool to retrieve the treating tool back to the surface.

* * * * *